US005589827A

United States Patent [19]

Scurati

[11] Patent Number: 5,589,827

[45] Date of Patent: Dec. 31, 1996

[54] INTERACTIVE METHOD FOR MONITORING ROAD TRAFFIC, AND ITS ONBOARD APPARATUS, AND SYSTEM FOR IMPLEMENTING THE METHOD

[75] Inventor: Mario Scurati, Milan, Italy

[73] Assignee: SGS-Thomson Microelectronics S.r.l., Agrate Brianza, Italy

[21] Appl. No.: 233,120

[22] Filed: Apr. 26, 1994

[30] Foreign Application Priority Data

May 11, 1993 [EP] European Pat. Off. ..... 93830197

[51] Int. Cl.[6] ..... G08B 1/00

[52] U.S. Cl. ..... 340/901; 340/902; 340/903; 340/905; 340/932; 180/167

[58] Field of Search ..... 340/901–905, 340/539, 425.1, 932, 435, 436; 180/167–171, 271

[56] References Cited

U.S. PATENT DOCUMENTS

| | | | |
|---|---|---|---|
| 4,706,086 | 11/1987 | Panizza | 340/902 |
| 5,068,654 | 11/1991 | Husher | 340/903 |
| 5,424,726 | 6/1995 | Beymer | 340/902 |

FOREIGN PATENT DOCUMENTS

| | | | |
|---|---|---|---|
| 0357963 | 3/1990 | European Pat. Off. . | |
| 2362765 | 6/1975 | Germany . | |
| 3915466 | 12/1989 | Germany . | |
| 404241100 | 8/1992 | Japan | 340/903 |
| 1380587 | 1/1975 | United Kingdom . | |

*Primary Examiner*—Donnie L. Crosland
*Attorney, Agent, or Firm*—Seed and Berry LLP; David V. Carlson; Bryan A. Santarelli

[57] ABSTRACT

An interactive method for monitoring road traffic consisting of detecting, using a short-range receiver installed on a vehicle, the presence of preceding vehicles in the same running direction and their dynamic conditions, as transmitted by the preceding vehicles, in the form of binary coded periodic message at nonoverlapped time windows for each vehicle. The method further consists of transmitting, to the following vehicles using a short-range transmitter installed on the vehicle, a binary coded message indicating the presence of the vehicle and, optionally, dynamic conditions of the preceding vehicles, at time windows non-overlapping the transmission time windows of the preceding vehicles.

22 Claims, 3 Drawing Sheets

INTERACTIVE METHOD FOR MONITORING ROAD TRAFFIC, AND ITS ONBOARD APPARATUS, AND SYSTEM FOR IMPLEMENTING THE METHOD

TECHNICAL FIELD

This invention relates to an interactive method for monitoring road traffic, as well as to an onboard apparatus and a system for implementing the method.

BACKGROUND OF THE INVENTION

Extensive investigation and research work has been devoted to the development of traffic monitoring systems which mostly employ fixed pickup stations for integrating, processing, and broadcasting information to road users.

The detection and transmission arrangements are mostly based on either radar, inductive cable, radio, or steered wave transmission systems. Such monitoring systems have essentially the following limitations: updating is performed at long time intervals; local measurements are taken at far apart locations; and integrated and averaged information is generated which relates to the dynamic conditions of groups of vehicles, not to the individual vehicles.

Vehicle-to-vehicle interactive systems, based on the use of radar devices or transponders to provide drivers with indications of headway or distance (and its variations)between vehicles, have long been proposed but have been unsuccessful because either impractical or limited by their purely local character, covering vehicle pairs only.

SUMMARY OF THE INVENTION

The present invention includes a method and an apparatus for broadcasting in real time information concerning road traffic conditions, traveling speed, vehicle acceleration/deceleration, headway, etc., hereinafter collectively referred to as "dynamic conditions." The system and the implemented method are directed to improve driving safety by ensuring real time warning of potentially hazardous and/or difficult traffic situations, thereby filling a long-felt need. The limitations of prior systems are overcome by the interactive method of the present invention for monitoring road, specifically superhighway or motorway, traffic according to this invention, wherein each vehicle, as equipped with a receiver, a short-range low-power transmitter, and a processor—hereinafter also denoted by the acronym "TBA" (Terminale a Bordo di Auto=Car-Mounted Terminal)—acts as a relaying unit in a chain of receivers/transmitters, whereby information can be propagated throughout a road section.

This method includes detecting, through the TBA, the presence of vehicles traveling ahead in the same running direction and their dynamic conditions, which are transmitted in the form of a binary (or decimal, or hexadecimal) coded periodic signal, for example, from each of the preceding vehicles, at non-overlapping time intervals for each vehicle, and of transmitting, through the onboard transmitter as synchronized to messages received from the preceding vehicles, a binary coded signal indicating at least the presence of the vehicle and dynamic conditions thereof to the following vehicles, at time intervals which do not overlap the transmission time intervals from the preceding vehicles whose presence has been detected. Thus, each vehicle operates as a moving station to sense in real time both its own dynamic conditions and those of the other vehicles ahead of it, in that it acts as a receiver and transmitter of information about the traffic flow.

According to a further aspect of this invention, therefore, the transmission takes place in a rearward or reverse direction from the running direction, in cascade between the various vehicles, to which is added useful information (dynamic conditions) concerning the preceding vehicles over a predetermined distance, on the occurrence of each reception/transmission.

According to a further aspect of this invention, the various vehicles which precede in the same running direction use the same transmission and reception frequency, and interference of the signals generated by several vehicles is avoided using a time-sharing method of transmission whereby each vehicle will periodically transmit a binary coded signal using, within one time frame, a time window not used by any other nearby vehicles.

According to a further aspect of this invention, the synchronization of transmissions between different vehicles, as required to prevent transmission interference, is of a dynamic type and related to a leading vehicle in the queue. The leading role may be played by any vehicle which is not preceded, within the reception range, by any other vehicle or fixed road section station.

According to a further aspect of this invention, the instantaneous dynamic conditions transmitted from each vehicle include the vehicle speed, deceleration (where applicable) and distance traveled from an absolute starting reference. This information, which is received in real time within the transmission and reception range, allows any potentially hazardous situation in the neighborhood to be detected. Additional information transmitted from each vehicle relates to the averaged dynamic conditions of vehicles traveling a distance ahead outside the reception/transmission range. Such information, which would be received by cascade propagation, is the outcome of the instantaneous dynamic condition processing carried out by the individual TBAs and represents averaged dynamic conditions of far or medium-distance traffic, so that appropriate decisions to meet such conditions can be made.

For implementing this method, a vehicle-mounted apparatus is provided which comprises a receiver and a transmitter, preferably but not necessarily, directional FM ones, logic circuits including a timer unit, a memory unit, and a microprocessor for temporarily storing received messages and processing them, generating messages to be transmitted, and transmitting the messages synchronously.

These onboard apparatus from a communications chain system which is largely self-maintained and can be suitably integrated to fixed apparatus supplying backup, initialization, etc., indications, which would locate at the entrance/exit ends of the superhighway or motorway section and suitably confine the monitoring system for more efficient and straightforward handling of same.

BRIEF DESCRIPTION OF THE DRAWINGS

The features and advantages of the invention will become more clearly apparent from the following description of a method according to this invention, and of an apparatus and a system for implementing the method, as well as from the accompanying drawings.

DETAILED DESCRIPTION OF THE INVENTION

Figure 1:
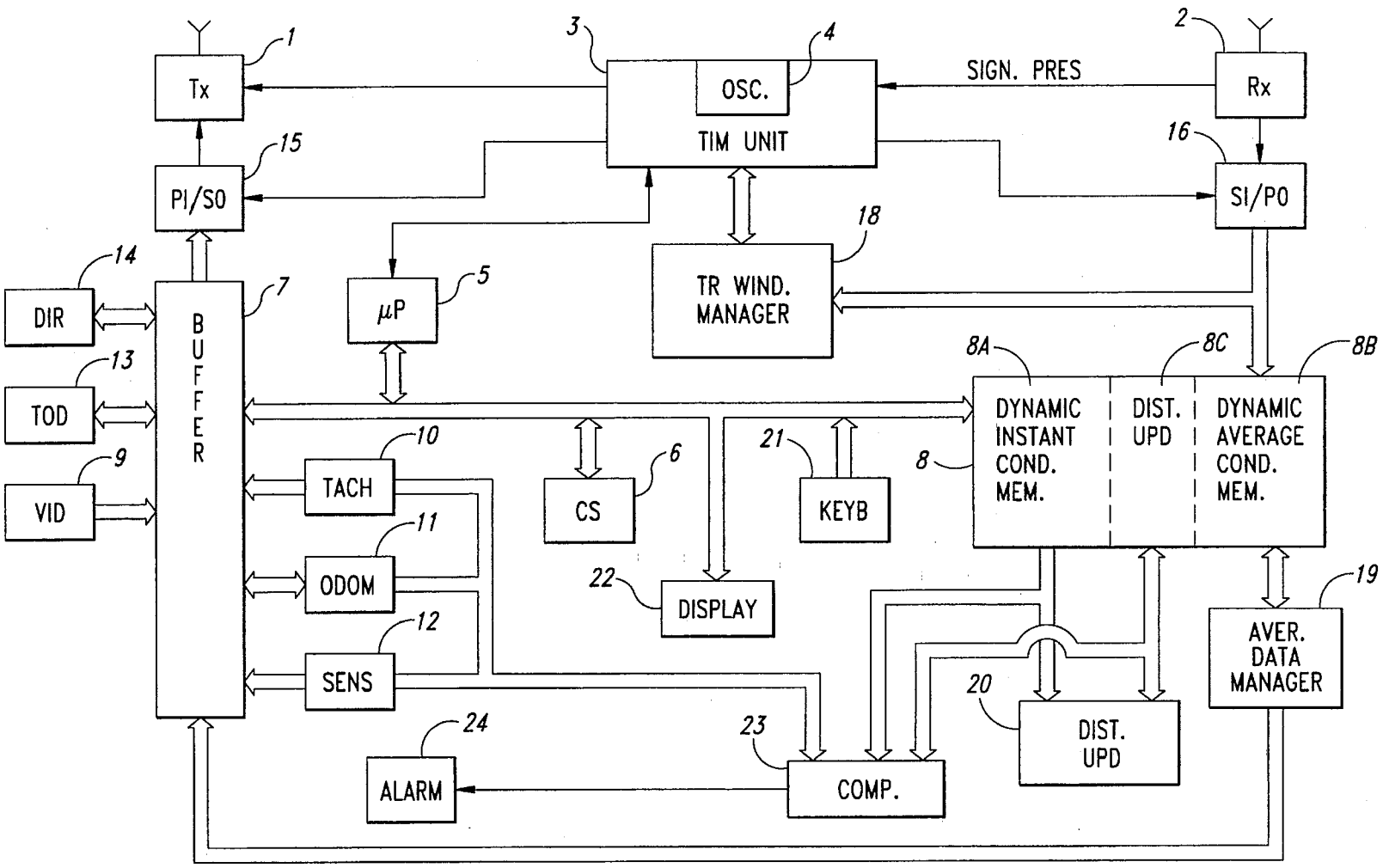
FIG. 1 is a block diagram of an onboard apparatus for implementing the method of this invention.

With reference to FIG. 1, an onboard apparatus according to the invention comprises a transmitter 1, a receiver 2, a timing unit 3 having an internal oscillator 4, a microprocessor 5, a control memory 6, a read/write memory split function-wise into plural buffers 7, 8, and digital dynamic condition generators, such as a vehicle (numberplate) identifier VID 9, a speedometer TACH 10, an odometer ODOM 11, braking and/or lane sensors SENS 12, a clock TOD 13, and a running direction indicator DIR 14. The memory 8 may be seen as divided into three modules 8A, 8B, 8C adapted to respectively store instantaneous dynamic conditions (DYNAMIC INSTANT COND MEM), averaged dynamic conditions (DYNAMIC AVERAGE COND MEM), and real time updatings of the vehicle distances (DIST UPD).

The apparatus is completed by shift registers PI/SO 15 having parallel inputs and serial outputs, shift registers SI/PO 16 having serial inputs and parallel outputs for writing/reading into/from the buffers 7, 8 which are, preferably but not necessarily, of the multi-port type to allow direct reading from the buffer 7 and writing in the buffer 8 through direct memory access mechanisms (DMA) without interfering with any concurrent activities of the microprocessor and without requiring its operation.

Also provided for this purpose are a transmission window manager unit TR WINDOW MAN 18, whose function is to be explained, for relieving the microprocessor 5 of transmission timing tasks, an averaged data manager (AVER DATA MANAGER) block 19 which continually re-processes the averaged dynamic conditions to update the relative distance data prior to re-transmitting it, and a distance updating (DIST.UPDT) block 20 to update, as by extrapolation, the distance run data by each car.

It may be appreciated that, by providing a microprocessor with adequate processing capacity, all the control functions of receiving/transmitting signals, reading/writing to the buffers, and updating data can be performed by the microprocessor itself. The apparatus is completed by a keyboard 21 for interrogating the TBA about specific conditions and presenting them on a display 22, and a comparator 23 for comparing and monitoring in real time vital information to traffic safety and for operating warning (ALARM) devices 24.

Before describing the operation of the apparatus in FIG. 1, in order to illustrate the method of this invention, it may be appropriate to review, with reference to FIGS. 2, 3, 4, 5, what the contents of the messages being received and transmitted by each vehicle are and their time relationships.

Each vehicle receives, through an onboard receiver which is assumed to be directional and to have a limited range rating of 300 m, the messages transmitted from all the vehicles possibly preceding it in the same running direction and being located within 300 m from it, this range being conservatively assumed to be extended to 600 meters to allow for exceptionally favorable weather conditions.

The number of the vehicles possibly falling within this range would depend on the characteristics of the road section. For instance, with three-lane superhighways or motorways, it can be assumed that their number would never exceed 256, including crawling queue situations. Actually, the number of vehicles is bound to be much smaller than that.

Figures 2, 3, 4, 5:
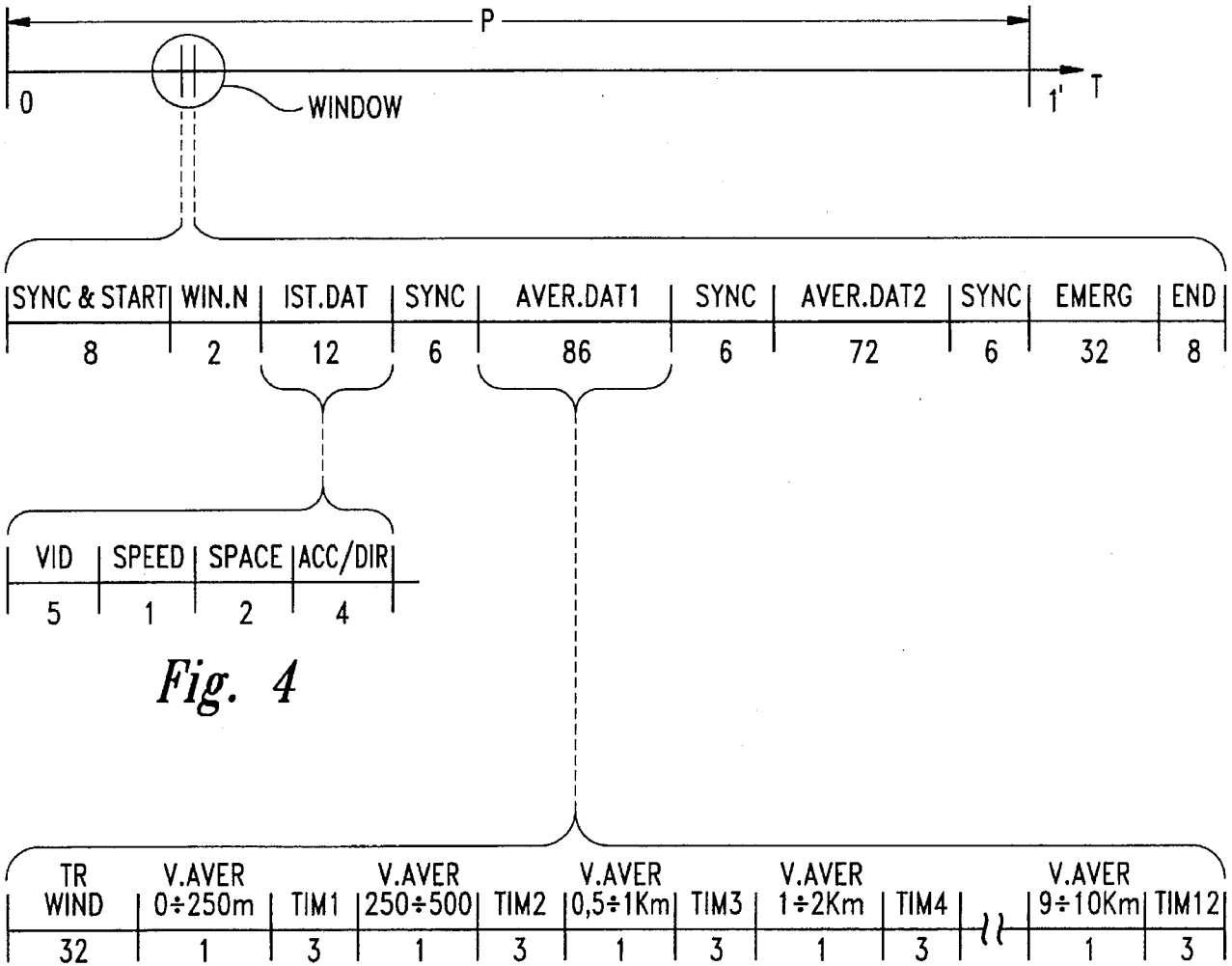
FIG. 2 is a time diagram of the allocation of a transmission window as used by a vehicle within one transmission period.
FIG. 3 shows, in diagrammatic form and as divided into fields, a preferred structure of a message from a vehicle within a transmission window.
FIG. 4 shows diagrammatically the structure and subdivision into subfields of a first field in FIG. 3.
FIG. 5 shows diagrammatically the structure and subdivision into subfields of a second field in FIG. 3.

To avoid transmission interference, therefore, each vehicle is to use a separate transmission time window from those of other vehicles to periodically issue messages having the same predetermined period for all the vehicles. Since the messages being transmitted would concern the inception of potentially hazardous situations, in order for the following drivers to maneuver in good time, the transmission period should be a short one, lasting no more than one second, for example. This means that, as shown in FIG. 2, each vehicle could be afforded a time window of no more than 1:256=4 msec.

The problem of vehicle synchronization has two facets: a first one concerns recognition of binary information being transmitted (using a carrier at a high frequency, e.g., on the order of hundreds of MHz) at a base frequency using modulation (such as PM, FM, NRZ, etc.) techniques which would allow recognition and frequency lockup either through conventional (PLO) circuits or sequences of several synchronization bits having an appropriate periodicity. In fact, while all the vehicles are setup to operate at the same transmission and reception carrier frequency rating and the same binary transfer rate, which may be set by specially accurate and stable crystal oscillators, it will be appreciated that frequency deviations between vehicle are possible. In practice, such deviations in the binary transfer rate can be limited to +100 ppm and, hence, readily recovered by transmitting synchronization fields.

A second facet concerns identification in time of the starting time of each period, and definition of its duration, which should be the same for all vehicles, and the location of the transmission windows within the period. This problem could be solved by providing one (or more) fixed station(s) to generate periodic timing signals with a sufficiently long range to cover the whole road section affected. This signal, when received by all the vehicles, would allow the period start and duration to be identified, and the internal timings to be matched accordingly.

A fixed local timing station with a limited range would be inadequate, on the other hand, because frequency drifts and attendant offsets would unavoidably occur outside its range.

According to one aspect of this invention, vehicle synchronization does not take place using an absolute fixed time reference, but rather using essentially the same transmission signals as are received from other vehicles or local stations which are, therefore, synchronized in cascade, in a related manner to one another with the possible exception of a leading vehicle which is receiving no signals.

As shown in FIG. 3, within the 4-msec transmission window used by a vehicle (and selected as explained hereinafter), a message is transmitted which comprises a bit string carrying the following meanings:

a first field SYNC & START, e.g., of 8 bytes, having a synchronization and frequency lockup function, and identifying the start of the message transmission;

a second field WIND.N., e.g., of 2 bytes, meaning the order number of the window used, and hence the location of the window in the period; this field is sent in real time as soon as it is received, from the register 16 to the unit 18 (FIG. 1), and enables the unit 18 to synchronize the timing unit 3 to the period used by the transmitting vehicle and to define which is to be the start of the next period (period synchronization);

a third field IST.DAT. e.g., of 12 bytes, describing in binary code the dynamic conditions of the transmitting vehicle:

fourth and fifth fields AVER DAT1 and AVER DAT2, e.g., of 80 and 72 bytes, respectively, describing in binary code the average running dynamic conditions of those vehicles which precede the transmitting vehicle within distance ranges which are predetermined by the transmitting vehicle; and a sixth field EMERG, e.g., of 32 bytes, being devoted to the transmission of a code indicating an emergency situation, as may arise from a situation of impending danger, e.g. sudden brake application resulting in greater deceleration than a predetermined value (e.g., greater than 30 m/s2).

Additionally to these fields, synchronization and lockup fields SYNC may be suitably interspersed which have 8 bytes each, and an end field END which has 8 bytes provided for closing the message.

In all, the message may comprise, for example, 234×8= 1872 bits which require a transfer rate of about 500 kbaud (about 2 μsec per bit) for their transmission within a time window of 4 msec.

It should be noted that according to a particular aspect of this invention, a time subwindow having a duration, in the assumed condition, of about 640 μsec will correspond to the field EMERG.

It is contemplated that this subwindow can be accessed by all the vehicles, not just by the one to which the current transmission window belongs. Concurrent transmission access by several vehicles to this time subwindow creates no problems from interference and misrecognition of the messages because, but for unavoidable limited offsets, the different vehicles are synchronized to one another and the signal propagation time differences over a range of 300 m do not exceed one microsecond.

When the emergency code, which is the same for all the vehicles, comprises, for example, a succession of bytes (not bits) alternately at 1 and 0 logic levels, the reception of the overlapping offset signals will not hinder recognition in the subfield of a succession of groups of bits alternately at a logic 1 and logic 0 level, at least so long as the offset is on the order of a few microseconds.

In this way (or using other equivalent expedients such as carrier activation or masking in the subwindow dedicated to emergency signal relaying), all the vehicles are enabled to transmit the emergency signal almost at once (with a time lag of no more than 4 msec from recognition of the critical event) without having to wait for their own transmission window.

FIG. 4 shows in greater detail the structure of the instantaneous data field IST DAT. Preferably, this field comprises:

a vehicle (numberplate) spotting code VID, e.g., of 5 bytes; a vehicle speed identifying code SPEED, e.g., of 1 byte, as measured by the speedometer 10;

a code SPACE (e.g., of 4 bytes) identifying (with a resolution of 1 m) the distance traveled by the vehicle, as measured by the odometer 11 which would be suitably and automatically initialized to an appropriate value as the vehicle enters the road section (absolute starting reference); and a code ACC, e.g., of 1 byte, for identifying a state of acceleration/deceleration and the extent thereof, as well as the running direction and the lane occupied as detected by the sensors 12 and 14 (e.g., 2 bytes).

It may be appreciated that to be safe, the above codes (as well as the transmission window identifying code) may be associated with error detection and correction codes.

FIG. 5 shows in detail the preferred structure for a first averaged data field AVER.DAT1. This field comprises:

a first code TR WIN, e.g., of 32 bytes, identifying time intervals or transmission windows already occupied by the vehicles which precede the vehicle generating this code, additionally to its reception field and within an appropriate distance range, e.g., of 1 km;

a second code, e.g., of one byte, indicating the averaged speed (mean speed of the individual vehicles) of the vehicles ahead within a predetermined distance range, e.g., 0 to 250 m;

a third code, e.g., of 3 bytes, indicating the time (hour, minute, second) of the measurement; and other subsequent codes which are equivalent to the second and the third and indicate the mean speed of the vehicles ahead within predetermined relative distance ranges, e.g., 250 to 500 m, 500 m to 1 km, 1 km to 2 km, 2 km to 3 km, and so forth up to 10 km, as well as the speed measurement time.

These speed codes are obviously constructed from cumulated information during transmission between vehicles which is processed by the onboard apparatus in view of the indication SPACE originally present in the instantaneous data which enables the relative distances between the transmitting vehicle and those ahead to be defined with good approximation.

Although the measurements of the distance traveled as provided by the odometer are affected by systematic errors, they are nonetheless far more accurate than a distance measurement based on the transmission/reception range and the number of re-transmissions of signals, from the source to the receiving vehicle involved.

The accuracy of the space measurement can be refined by means of expedients to be explained.

Quite similar is the structure of the field AVER DAT 2 which can supply indications of the mean speed over the 90 km after the first 10 km (relative distance of the individual receiving TBAs) divided into intervals of 10 km each.

The space-speed-time relationship thus obtained may either be absolute (referred to road subsections identified by the space indication from the start of the road section) or relative (distance from the vehicle receiving the information) in view of the distance traveled by it.

With these assumptions, the re-transmission mechanism between vehicles enables the traffic condition to be known 100 km away with a time lag which would at worst be on the order of 4 minutes. The worst case considered corresponds to a traffic situation wherein a single vehicle is present within the transmission range of the vehicle ahead and the transmission window used by the vehicle ahead follows that used by the following vehicle directly.

In the instance of a random selection of the transmission windows (from the available ones) by the vehicles, the average delay would be on the order of minutes. In practice, nothing would forbid each vehicle from synchronizing itself to the vehicles ahead by selecting the first available transmission window following in time those used by the vehicles ahead. In this case, the delay in propagating the information would be drastically reduced to within a few seconds.

The relay mechanism for transferring the messages assumes the presence of vehicles which are a distance apart not exceeding the transmission/reception range all along the road section. This restriction can be easily overcome by providing fixed installations along the road section, e.g., set 10 km apart from each other or at the gates of a superhighway, which receive (by radio or cable) information about the traffic conditions and relay it locally (with a reduced transmission range of 100–300 m, for example) to the running vehicles through one or more privileged transmission windows within the period. Such stations tune in to the running vehicles, or conversely, the running vehicles tune in thereto. Such stations preferably also provide, with a margin for uncertainty due to transmission range and time, a useful distance indication for odometer trip zeroing on the running vehicles.

In combination with inductive or optical devices placed on the road blanket and co-operating with onboard sensors providing spatial confirmation of the received information, uncertainty can be completely eliminated from trip zeroing and systematic measurement errors of the onboard odometer can be corrected (using two measured base validations).

It now becomes possible to describe with reference to FIG. 1 how the method and apparatus of this invention operate in connection with the different possible cases.

1st Case: isolated non-initialized vehicle, that is outside an assisted system.

Isolated non-initialized vehicle means a vehicle at a greater distance from other vehicles than the transmission/reception range and receiving, therefore, no signals. In addition, the vehicle has previously received no signals enabling it to initialize and synchronize the onboard instrumentation to such information as the spatial position, running direction, and possible others.

Absent any signal from the detector 2, the onboard apparatus will operate on its own account and the timing unit 3 will randomly define the time location of the transmission period whose duration is defined as a predetermined multiple of the oscillator 4 period. The managing unit for the transmission window 18 arbitrarily defines the location of the transmission window within the period.

The microprocessor 5 and timing unit 3 control the transmitter 1 to periodically output messages which comprise the fields of SYNC & START, and possibly the bits of the "Emerg" field. When the vehicle is equipped with compass sensors which allow the running direction to be defined, this indication too can be transmitted. These indications can be utilized by vehicles which follow a smaller distance away than the transmission/reception range to detect potentially hazardous situations (transmission of the data field "Emerg").

Under such circumstances of the first case, any vehicle mileage indication would be meaningless.

If the vehicle presently enters the transmission range of one or more vehicles ahead of it, the receiver 2 will begin to receive signals and assert a signal SIGN.PRES, indicating reception of a signal is in progress, to the timing unit 3.

Should a transmission from the transmitter 1 be concurrently in progress under control by the timing unit 3, this is taken to mean that two transmissions are interfering with each other and that the vehicle is not synchronized to the vehicles ahead. Therefore, the transmitter 1 is clamped off. Any following vehicles would then receive a partial message which may be ignored or acknowledged as it is.

On receiving the SYNC & START heading of the message, the timing unit 3 can synchronize itself to the ahead vehicles.

2nd Case: vehicle entering an assisted road section.

Assisted road section means here a checked access section at whose entrance or adit(s) stations for initializing the onboard apparatus are provided. The stations can be equipped with receiving and transmitting apparatus quite similar to the onboard TBA apparatus, and can function as synchronization masters to impose their synchronization on all vehicles entering their transmission range, or as slaves tied to the synchronization being imposed on them by the passing vehicles.

Expediently, the initializing stations would use one or more dedicated transmission windows to transfer information to the incoming vehicles over a transmission period being equal to or a multiple of that used by the vehicles. These stations serve to initialize the onboard apparatus, issuing information about the spatial position (km) of the station, exact time, and conventional running direction. This information, when received by the onboard TBA apparatus, allows the onboard instruments to be set.

In particular, the space indication can be confirmed and made accurate as the vehicle moves past electromagnetic, optical or mechanical devices cooperating with onboard sensors.

At this time, each vehicle entering the assisted section will have all the necessary basic information available for generating the information contained in the already discussed messages, and specifically the vehicle spatial position SPACE of the instantaneous data field, running direction, travel lane (which is to be checked and altered continually by the onboard sensors), and the exact time of message transmission.

Each TBA becomes, therefore, the transmitting element of an instantaneous data message related to the vehicle, which message will be added the reception of further instantaneous data averaged by the vehicles ahead. Such data is suitably processed and relayed onwards. The information received from a preceding vehicle is updated once each second on the average in a non-sequential manner (the position of the time window used does not reflect the physical position of the car within a car queue).

Accordingly, to avoid detecting nonexistent hazardous conditions (such as a possible spatial collision of vehicles), almost continual updating is performed by extrapolation (e.g., every 50 or 100 msec) through the distance updating block 20 (DIST UPDT) for the received instantaneous dynamic conditions (speed, space), and by comparison with the dynamic conditions of the receiving vehicle via the comparator 23.

3rd Case: vehicles running through an assisted section.

Figure 6:
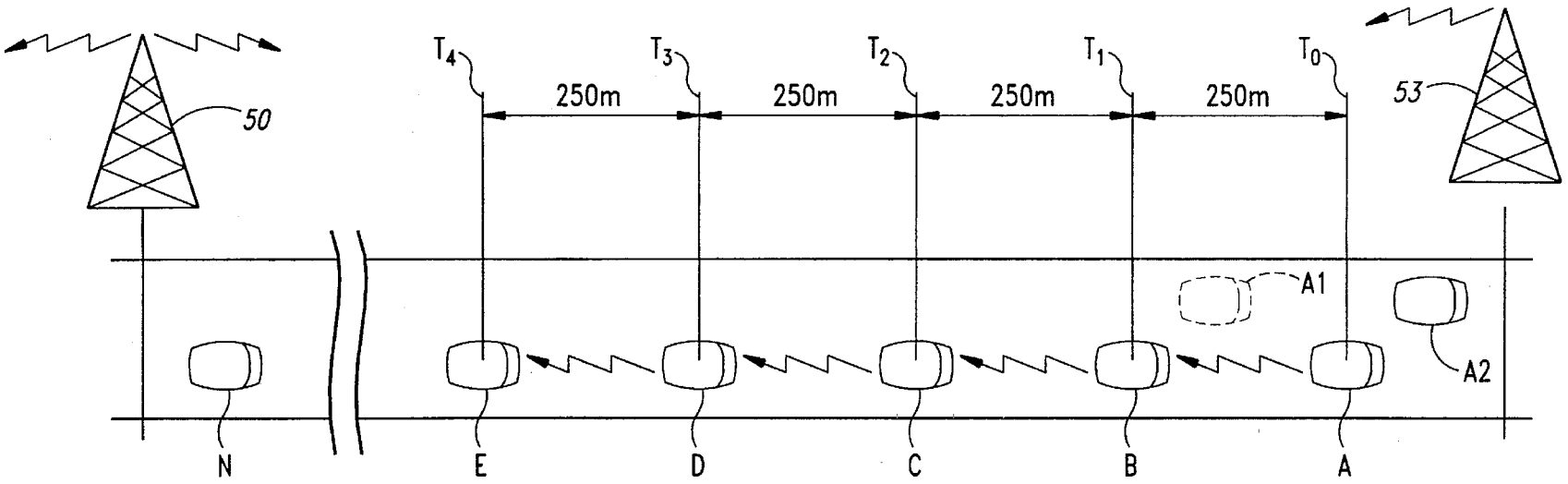
FIG. 6 shows diagrammatically the structure of a system for monitoring a road section according to the invention.

The behavior of vehicles going through an assisted section can be readily understood from examination of FIG. 6 (and with reference to FIG. 1, where appropriate), which shows diagrammatically an assisted section having an entrance or adit gate 50 and associated initializing station, an end exit gate 53 and associated clearing station and intermediate adit/exit gates 51, 52 therebetween (not shown). each provided with associated initializing/clearing station.

The gates 51, 52, 53 are operative to clear outgoing vehicles of information no longer meaningful on leaving the section, such as running direction indications (unless a vehicle is equipped with indicators of its own which are based on a common reference unrelated to the section, such as a compass).

The road section is occupied by a number of vehicles A, B, C, D, E, N, following one another in that order toward the exit gate 53.

Since the messages are transferred in the reverse order, the cumulated information stream from vehicle A to vehicle N will be expediently considered.

It will be assumed that no vehicles are preceding A, and that vehicle B is following 250 m behind vehicle A within the receive/transmit range of both vehicles, A and B.

Leaving aside the aspects connected with synchronization of the vehicles, already reviewed hereinabove, vehicle A will transmit at a time T0 information concerning its identity (numberplate), speed, acceleration, and spatial position relatively to an absolute reference such as gate 50.

This information is received by vehicle B, which will load it into the buffer 8 (FIG. 1). Vehicle B may also receive, m subsequent times, further like information from other vehicles, such as A1, between B and A.

At a time T1, which may lag some 4 msec to 1 sec behind, according to the position of the transmission window of B relative to A, vehicle B will be transmitting information concerning its speed, distance, and acceleration.

To this information, are added indications of the average speed of vehicles A and A1 ahead and of the measurement transmission time. These indications are generated by the microprocessor 5 and/or the block 19 (AVER DATA MANAGER) which will read the information 8 stored in the buffer 8, compute its mean value and store it into the buffer 7 for later transmission.

Since there are no more vehicles ahead of A, whose average speed is indicated, the speed average of A and A1 is taken as the average speed of all the vehicles ahead of B within a 250 m range.

The whole of this information is received by vehicle C, which is assumedly no more than 250 m away, along with additional like information received from other vehicles within the reception range of C.

At a time T2 after T1, vehicle C will transmit information about its speed, spatial position (hence, distance), and acceleration.

Added to this information is an indication of the average speed of the vehicles (such as B) preceding it within the 250 m range and of the recording time.

All this information is relayed onwards, however, as relating to vehicles ahead of C within the 250 to 500 m range.

Vehicle D, assumedly following 250 m behind vehicle C, will receive this information and relay it at a time T3.

In this case, the averaged information originating from vehicle B is relayed as information concerning vehicles ahead of D within the 0.5 to 1 km range, and that originating from vehicle C as concerning vehicles ahead of D in the 250 to 500 m range.

The relaying process from vehicle D to the following vehicle E (also 250 m away) is quite similar.

The single difference is that the information within the 0.5 to 1 km range will not be transferred (logically) to the range relating to vehicles 1 to 2 km away, and may only be further averaged with values which move into the 0.5 to 1 km range from the 250–500 m range.

The information related to the 0.5–1 km range will only be transferred to the 1–2 km range on the occurrence of two transmission periods and 4 successive transmission periods for the following ranges up to a 1 km scope.

The information of the 1 km scope ranges is transferred to the 10 km scope ranges every 40 successive transmission periods.

As explained above, the averaged data manager block 19 continually re-processes the averaged data conditions to update the relative distance data prior to retransmitting it. The averaged data manager block 19 is preferably a digital processor or microprocessor that periodically reads the speed of the vehicles ahead, their spatial position, and the time of reading, i.e., the time at which the information has been received. This data is stored in the memory 8A. The averaged data manager block 19 preferably reads this information at the same frequency as the transmission window (i.e., 4 msec). Based on this information, the average data manager block 19 computes the actual position of the vehicles ahead at the current time and stores the updated spatial positions in the memory 8C.

Similarly, the distance updating block 20 is preferably a digital processor or microprocessor that periodically reads the distance of the vehicles ahead and computes their distances. As used herein, the word "distance" means a spatial position relative to a common reference point. Therefore, the distance among vehicles is obtained by comparing their distances from a common reference point. While a single microprocessor such as the microprocessor 5 can perform the functions of the average data manager block 19 and the distance updating block 20, it is more convenient, from an economical standpoint, to have different computing units devoted to specific and repetitive tasks. Specific digital processing circuits, rather than microprocessors, may be more economical for such repetitive tasks.

The timing unit 30 can be implemented by a variety of different circuits known by those skilled in the art to perform the function described based on the detailed description provided herein, and may include a state machine or two cascaded counters. For example, if the timing unit 30 is implemented using two cascaded counters, the first counter clocked by the oscillator 4, provides information as to the beginning of a time window. The SIGN PRES signal is used as a reset signal for the first counter, and synchronizes the counter with the time windows received by the receiver 2. Identification of a received time window within the frame can be made only upon reading the field WIND.N by the transmission window manager 18. The transmission window manager 18 uses the WIND.N field as a preset code for the second counter as noted below and herein.

In addition to two counters (and the oscillator), the timing unit 3 can also include a decoder to detect the states of the first and second counters. The decoder, upon detecting an appropriate state of the first and second counters, provides load control signals to the registers 15 and 16 to allow appropriate loading/unloading of data to/from these registers. The decoder in the timing unit 3 also receives a control signal from the transmission window manager 18 as described below and herein, and in turn provides control signals to the transmitter 1 and the register 15 to allow appropriate exchange of data from the buffer 7 to the register 15 and transmission of the data in the register 15 by the transmitter 1.

The transmission window manager 18 can also be implemented by a variety of circuits known by those skilled in the relevant art to perform the function described herein based on the detailed description provided herein, such as a dedicated microprocessor or a register with a decoder. As noted herein, the transmission window manager 18 performs the task of detecting in the received information streams, the WIND.N code, and thus detects the windows used by the vehicles ahead of the present vehicle to select a free window.

For example, if the transmission window manager 18 is implemented using a register, the register is large enough to have one cell for each possible window in the frame. The timing unit 3 synchronizes this register to the frame. Every time a WIND.N signal is received, a register cell related to that particular window is set to a 1 value. At the end of a frame, the transmission window manager 18 sequentially reads the register to identify an available window and selects such an available window (e.g., preferably the first available window detected by sequential scanning is selected). After selecting an available window, the transmission window manager 18 provides the control signal to the timing unit 3 at the appropriate time to allow the timing unit 3 to control the transmission of data from the register 15 by the transmitter 1, as described herein.

The number of the selected available window WIND.N is stored in the memory 8 and is read by the microprocessor 5 for compiling messages to be transmitted. The microprocessor 5 is clocked by the timing unit 3 and can provide signals to the timing unit. Consequently, the microprocessor 5 could, in an alternative embodiment, read the WIND.N signal from the memory 8 and provide the control signal to the timing unit 3, instructing the timing unit 3 to provide timed loading of data into the register 15 and proper transmission of the data by the transmitter 1.

The process outlined above only holds for static conditions and for vehicles which are exactly 250 m apart.

However, it will be appreciated by those skilled in the relevant art that the actual range of each relaying operation can be taken into account by associating, with each field of averaged values, a code indicating the actual relaying range and being progressively incremented.

The foregoing description is understood to be exemplary and non-limitative of the method and the apparatus according to the invention, and has been simplified for a more convenient illustration of their basic features, which consist of relaying, rearwards between vehicles along a road section, instantaneous information about dynamic conditions of each of the vehicles and averaged dynamic conditions related to definite space and time positions, and all this by a method which prevents vehicle transmission interference.

The Instantaneous Dynamic conditions identified preferably include speed, acceleration, and spatial positions, where allowed for by outside backup enabling measuring errors to be corrected, but may also include (as regards the Averaged Dynamic Conditions) such other factors as the number of vehicles present within predetermined space and time ranges or an indication of the traffic density and evenness, any significant deviations from the mean values, and so forth, as well as outside originated information (police, weather reports, roadworks ahead, etc.).

Thus, the described method and apparatus variants may be many fold.

In particular, to restrict the transmission interference problem (solved using time sharing techniques) to just vehicles which are running and precede in the same direction, no directional transmitters and receivers are required.

Directional selectivity can be obtained, for example, by using two different carrier frequencies according to running direction, and discrimination between preceding and following vehicles (whose messages may be ignored) can be obtained by recognizing the spatial and relative positions of the vehicles.

Within this frame, recognition of the following vehicles (and likewise, misrecognition of the vehicles ahead) may be useful to match the transmitting power (or receiving sensitiveness in the instance of the vehicles ahead), and hence the range under specific traffic conditions to provide in all events cascaded intercommunications between the vehicles with no loss of information and no need for fixed backup installations to relay transmission even under light traffic conditions. In addition, this system affords advantages in terms of minimized synchronization interference, if any.

In fact, when a leading vehicle in a group of vehicles is forced to select another transmission window in approaching a group of vehicles ahead, it can do it taking into account the transmission windows being used by the following vehicles as well, to avoid interfering with their transmission windows.

Other possible variants under the present invention relate to the structure of the information being transmitted, particularly in view of that certain averaged information about remote traffic conditions is actually updated at longer intervals than the transmission period.

Thus, it becomes possible to spread such information, as identified by an associated code, over plural successive transmission windows.

In this way, the number of bits to be transferred to each transmission window can be reduced substantially, and for a given transmission period and logic rate, the number of transmission windows can be increased, or the transmission period reduced for the same transmission logic rate and window number.

The hazardous and emergency situations which have been indicated as identifiable by way of example, such as sudden braking of preceding vehicles and excessive speed relative to the preceding vehicles, may be expanded to include different situations, such as excessive speed of the following vehicles, unsafe headway, overtaking and lane jumping.

Some advantages offered by the method, apparatus and system according to the present invention over known solutions are, in addition to low manufacturing cost as afforded by their low-power microelectronics, high applicational versatility and the ability to integrate far-apart functions, such as detecting local dynamic conditions and detecting and cumulating remote but averaged conditions to one vehicle with no need for expensive fixed installations.

The foregoing description makes no mention of how the information picked up by the onboard apparatus can be put to use because this is irrelevant for the purposes of this invention.

It will be appreciated that the onboard apparatus may include sound and optical devices to give warning of a danger or an emergency, automatic devices acting on the engine fuel system or the vehicle brake system, and voice or keyboard interrogation devices for displaying in voice or visual forms information selected or processed by the apparatus from the collected data.

Although specific embodiments of the invention have been described for purposes of illustration, various modifications may be made without departing from the spirit and scope of the invention, as is known by those skilled in the art. Accordingly, the invention is not limited by the disclosure, but instead its scope is to be determined entirely by reference to the following claims.

I claim:

1. An interactive method for monitoring road traffic, comprising the steps of:

detecting, through a receiver and a processor installed on a vehicle, said processor being coupled to said receiver, the presence of vehicles traveling ahead in the same running direction and their dynamic conditions; as transmitted in the form of a coded message from each of said preceding vehicles, at defined transmission time windows that are different for each vehicle, within a transmission period comprising a plurality of time windows, detecting through said receiver and said processor, said transmission time windows and their position within said transmission period and transmitting, through a transmitter installed on the vehicle, and capable of recognizing received messages, a coded message indicating at least the presence of said vehicle and dynamic conditions thereof to following vehicles, traveling in the same running direction, at separate time windows from said detected transmission time windows of the preceding vehicles whose presence has been detected.

2. A method as claimed in claim 1 wherein said transmission time windows include an emergency signal transmission field for overlapped use by several vehicles, said emergency field being used upon recognition by a vehicle of an emergency situation, the recognition of a deceleration state in excess of a predetermined value constituting an emergency situation.

3. A method as claimed in claim 1 wherein said instantaneous dynamic conditions include traveling speed.

4. A method as claimed in claim 3 wherein a vehicle identifier is associated with said speed.

5. A method as claimed in claim 1 wherein said coded message transmitted by said vehicle includes identification of the time windows used by said preceding vehicles and an indication of the mean speed of said preceding vehicles.

6. A method as claimed in claim 5 wherein said coded message transmitted by said vehicle includes an indication of the spatial position of said vehicle and a plurality of indications, each concerning the mean speed of preceding vehicles in the same direction within predetermined distance ranges.

7. A method as claimed in claim 5 wherein said transmitted coded message includes an indication of the direction in which said vehicle is proceeding.

8. A vehicle-mounted apparatus for interactive road traffic monitoring by a vehicle, comprising:

a receiver, for receiving a plurality of periodic signals being transmitted from one or more preceding vehicles traveling ahead in the same running direction at defined time windows, each of said periodic signals indicating the presence of several preceding vehicles and their dynamic conditions, first comparator means for comparing said plurality of periodic signals with at least one dynamic condition of said vehicle, said comparator having an output coupled to a warning device for its operation;

means for processing said plurality of signals to generate a mean value of said dynamic conditions of said preceding vehicles; and a transmitter, synchronized by at least one of said periodic signals received by said receiver, to transmit, at separate time windows from the received time windows of said plurality of received periodic signals, a periodic signal indicating at least one dynamic condition of said vehicle and said mean value of dynamic conditions of said preceding vehicles.

9. An apparatus as claimed in claim 8, including means for identifying the transmission time windows of each of said plurality of received periodic signals to associate, with said mean value of dynamic conditions of said preceding vehicles, an identification code of said time windows.

10. An apparatus as claimed in claim 8, including a reset means for setting distance traveled and elapsed time measuring means back to an original state in response to a received initialization signal.

11. An interactive road traffic monitoring system, comprising a plurality of vehicle-mounted apparatus, each as claimed in claim 8, and a plurality of means, one for each adit to a road section, for generating and transmitting said initialization signal.

12. A method of monitoring road traffic by a vehicle, comprising the steps of:

receiving a coded signal periodically transmitted from a preceding vehicle, traveling ahead in the same running direction, during a defined time window within a time period comprising a plurality of time windows, the coded signal indicating the dynamic conditions of the preceding vehicle;

monitoring a dynamic condition of the vehicle and producing a monitored signal;

generating a combined signal from the coded signal and the monitored signal;

selecting a time window different from said defined time window and within said time period; and transmitting the combined signal to at least one subsequent vehicle traveling in the same running direction during said selected time window.

13. The method of claim 12 wherein the step of generating includes the step of determining a mean value of the dynamic conditions of the preceding vehicle.

14. The method of claim 12 wherein the combined signal includes a vehicle data field indicating at least one of an identification of the vehicle, a speed of the vehicle or a braking condition of the vehicle.

15. The method of claim 13 wherein the defined and selected time windows include an emergency data field indicating a potential emergency condition, the emergency data field for overlapping use by the preceding vehicle and the vehicle.

16. A vehicle-mounted apparatus for interactive road traffic monitoring comprising:

a receiver for receiving a plurality of periodic signals being transmitted at defined time windows, each periodic signal indicating a presence of at least one preceding vehicle and dynamic conditions of the at least one preceding vehicle;

a processor circuit, coupled to the receiver, for comparing the plurality of periodic signals with at least one dynamic condition of the vehicle and generating a combined value of the dynamic conditions of the at least one preceding vehicle and the at least one dynamic condition of the vehicle; and a transmitter, coupled to the processor circuit and synchronized by at least one of the periodic signals received by the receiver, the transmitter transmitting at separate time windows from the defined time windows of the plurality of received periodic signals, a periodic vehicle signal indicating the at least one dynamic condition of the vehicle and the combined value of the dynamic conditions of the at least one preceding vehicle.

17. The apparatus of claim 16, further comprising a memory coupled to the processor circuit, the memory storing the at least one dynamic condition of the vehicle and the dynamic conditions of the at least one preceding vehicle, wherein the processor circuit includes an average data manager circuit coupled to the memory and wherein the combined value is a mean value of the dynamic conditions of the at least one preceding vehicle generated by the average data rummager circuit in response to the dynamic conditions of the preceding vehicles.

18. The apparatus of claim 16, further comprising a timing circuit, and wherein the processor circuit includes a timing window manager circuit coupled between the timing circuit and the processor circuit, the timing circuit and time window manager circuit determining if one of the time windows of the plurality of received periodic signals equals the separate time windows of the periodic vehicle signal and selecting new time windows unequal to the received time windows of the plurality of received periodic signals to transmit the periodic vehicle signal.

19. The apparatus of claim 16, further comprising at least one of a vehicle identifier, a speedometer, an odometer, a clock, a running direction indicator, and a braking sensor, coupled to the processor and providing the at least one dynamic condition of the vehicle.

20. The apparatus of claim 16 wherein the processor circuit includes a comparator and a distance updating circuit, the distance updating circuit extrapolating a distance of at least one of the preceding vehicles based on the received plurality of periodic signals, the comparator comparing the updated distance and comparing it to the at least one dynamic condition of the vehicle.

21. An interactive method for monitoring road traffic, comprising:

detecting, through a receiver and a processor installed on a vehicle, said processor being coupled to said receiver, the presence of vehicles traveling ahead in the same running direction and their dynamic conditions, as transmitted in the form of a coded message from each of said preceding vehicles, at defined transmission time windows that are different for each vehicle and within a transmission period comprising a plurality of time windows;

detecting through said receiver and said processor said transmission time windows and their position within said transmission period; and transmitting through a transmitter that is synchronized by at least one of said coded messages from said preceding vehicles, installed on the vehicle, and capable of recognizing received messages, a coded message indicating at least the presence of said vehicle and dynamic conditions thereof to following vehicles at a time window in said transmission period, said time window separate from said detected transmission time windows of the preceding vehicles whose presence has been detected.

22. A method of monitoring road traffic by a vehicle, comprising:

receiving a coded signal transmitted from a preceding vehicle during defined time windows that are located at one or more window positions within a transmission period, the coded signal indicating dynamic conditions of the preceding vehicle;

identifying from said coded signal said one or more window positions of said transmission period;

selecting a time window within said transmission period and having a window position that is different from said one or more window positions;

monitoring a dynamic condition of the vehicle and producing a monitored signal;

generating a combined signal from the coded signal and the monitored signal; and transmitting the combined signal to at least one subsequent vehicle during said selected time window.

* * * * *

UNITED STATES PATENT AND TRADEMARK OFFICE

CERTIFICATE OF CORRECTION

| | | |
|---|---|---|
| PATENT NO. | : | 5,589,827 |
| DATED | : | December 31, 1996 |
| INVENTOR(S) | : | Mario Scurati |

It is certified that error appears in the above identified patent and that said Letters Patent is hereby corrected as shown below:

In column 15, claim 17, line 6, please delete "rummager" and insert therefor --manager--.

Signed and Sealed this

Twelfth Day of August, 1997

Bruce Lehman

*Attest:*

BRUCE LEHMAN

*Attesting Officer*

*Commissioner of Patents and Trademarks*